US005579099A

United States Patent [19]

Nishiyama et al.

[11] Patent Number: 5,579,099

[45] Date of Patent: Nov. 26, 1996

[54] DOCUMENT CONVEYING DEVICE AND DOCUMENT READING DEVICE OPERABLE THEREWITH

[75] Inventors: Kouji Nishiyama; Yoshio Toyoshima, both of Yashio, Japan

[73] Assignee: Ricoh Company, Ltd., Tokyo, Japan

[21] Appl. No.: 378,721

[22] Filed: Jan. 26, 1995

[30] Foreign Application Priority Data

Jan. 26, 1994 [JP] Japan ..... 6-006762

[51] Int. Cl.[6] ..... G03G 21/00

[52] U.S. Cl. ..... 355/308; 271/3.03; 358/488; 358/498

[58] Field of Search ..... 355/308, 318; 358/488, 498; 271/3.03, 3.06

[56] References Cited

U.S. PATENT DOCUMENTS 4,979,727 12/1990 Koike et al. ..... 271/3.03
5,339,139 8/1994 Fullerton et al. ..... 355/308 X
5,430,536 7/1995 Fullerton et al. ..... 355/308 X
5,438,435 8/1995 Lawniczak ..... 355/308 X

*Primary Examiner*—Fred L. Braun
*Attorney, Agent, or Firm*—Oblon, Spivak, McClelland, Maier & Neustadt, P.C.

[57] ABSTRACT

A document conveying device for conveying a document in a reciprocating motion, and a document reading device for reading the image of the document by illuminating it from one edge thereof. The document is turned over and conveyed back and forth to an illuminating position and a position below a document table. A document receiving section for receiving and storing the document after it has been read the desired number of times is provided intermediate the document table and the illuminating position of the document reading device. This allows, in a reciprocation system, a document to be laid on the table face up and allows the next document to be laid on the table beforehand.

4 Claims, 7 Drawing Sheets

DOCUMENT CONVEYING DEVICE AND DOCUMENT READING DEVICE OPERABLE THEREWITH

BACKGROUND OF THE INVENTION

The present invention relates to a document conveying device and a document reading device operable therewith and, more particularly, to a document conveying device capable of conveying a document back and forth, and a document reading device for reading the image of the document by illuminating it from one edge to the other edge.

An image reading device of the type reading a document moving via an illuminating position by sequentially illuminating it from one edge to the other edge i s conventional. This type of device is often loaded with a document conveying device capable of conveying, when a single document should be read a plurality of times, the document a plurality of times via the illuminating position. The document conveying device is generally implemented by either a loop circulation system or a horizontal reciprocation system. Document conveying devices using the loop circulation system (referred to as first type of devices hereinafter) are disclosed in, for example, Japanese Patent Laid-Open Publication Nos. 60-83930 and 4-172372, Japanese Patent Publication Nos. 62-61273 and 2-16516, and Japanese Utility Model Laid-Open Publication Nos. 60-177140 and 61-194822. Document conveying devices using the horizontal circulation system (referred to as a second type of devices hereinafter) are taught in, for example, Japanese Patent Laid-Open Publication Nos. 57-83965, 59-154464, 2-129669 and 4-29543, and Japanese Utility Model Laid-Open Publication Nos. 64-43349 and 4-79844.

The problem with the first type of document conveying device is that a document of relatively large size cannot be repeatedly circulated via the glass platen unless the loop is long enough to accommodate even such a document. Such a long loop makes the device bulky and increases the number of parts and, therefore, the cost. The second type of device is free from this problem. Specifically, the second type of device causes drive rollers to convey a document horizontally in a reciprocating motion between an upstream position and a downstream position via a glass platen. However, the second type of device has the following problem. As to the first type of device, a document expected to be turned over is stacked on a document table face up and, therefore, easy to see the orientation of an image. However, with the second type of device, it is necessary to lay the document on the table face down since it is not turned over during the reciprocating motion. Hence, it is troublesome to see the orientation of an image when, for example, the leading edge of a paper should be left blank over a desired distance. Moreover, since the document fed forward is again returned to the table, another document to be scanned cannot be laid on the table beforehand. This lowers the maneuverability of the device.

The problems stated above can be obviated by a third type of document conveying device taught in Japanese Patent Laid-Open Publication No. 4-29543. Specifically, the third type of device, like the first type of device, has a document table above a glass platen and causes a turn roller 14 and a driven roller to turn over a document via a turn path. At the same time, this type of device causes the drive roller, turn roller and driven roller to convey the document P horizontally in a reciprocating motion via the glass platen. Even the third type of device has some issues yet to be solved, as follows. Since the document is turned over and then moved along the glass platen, it is driven out to a document tray located at the left-hand side of the device. A document reading device loaded with the third type of device illuminates the document being moved from the right to the left of the device, so that a photoconductive drum is rotated counterclockwise to discharge the paper to the right. Generally, therefore, a document reading device capable of reading a document having, for example, a great width is so oriented as to locate the operating section thereof at the left-hand side. Then, since the papers are driven out to the right-hand side or rear of the device, the operator cannot take them out unless stepping round to the rear of the device. This is also true with the first type of device. The second type of device allows the table and stacker to be located at the front of the device since it moves the document back and forth horizontally. However, even the second type of device forces the operator to step round to the rear of the device for taking out the document received by the tray.

The following arrangement may be contemplated in order to eliminate the above problems. In the arrangement, the third type of document conveying device is mounted on a document reading device. A paper expected to be driven out by a heat roller is redirected to a discharge roller. As a result, the discharge roller discharges the paper to the top rear side. A stacker for stacking papers is mounted on the top of the document reading device. Such a scheme will allow both the document and the papers to be collected at the front of the device. However, this cannot be done with the horizontal reciprocation system since the document is moved horizontally even to the top rear side of the device where the paper should be driven out.

The first type of device using the loop circulation system may be provided with means for correcting the skew or offset of a document in conveyance, as taught in, for example, Japanese Patent Laid-Open Publication No. 4-172372, Japanese Patent Publication No. 2-16516, or Japanese Utility Model Laid-Open Publication No. 60-177140 or 3-73551. Although the correcting means is applicable to the second or the third type of device, it is too complicated and expensive to implement an inexpensive document conveying device using the horizontal reciprocating system. As a result, the document conveyance accuracy achievable with the third type of device is low.

SUMMARY OF THE INVENTION

It is, therefore, an object of the present invention to provide a document conveying device allowing, despite it uses a reciprocation system, a document to be laid on a table face up and allowing the next document to be laid on the table beforehand so as to enhance maneuverability and reduce cost.

It is another object of the present invention to provide an inexpensive document conveying device capable of easily correcting the skew and offset of a document with a simple implementation.

It is a further object of the present invention to provide a document reading device allowing documents and papers to be collected at the front of the device.

In accordance with the present invention, In a document conveying device mounted on a document reading device which sequentially reads a document image moving via an illuminating position with an illuminating section thereof from one edge of the document, and for conveying, when an image of a single document is illuminated by the document reading means a plurality of times, the document in a reciprocating motion via the illuminating position, a document table is located above the illuminating section for supporting a document laid thereon and guiding the document to an inlet. A turning section turns over the document inserted into the inlet and guides it to the illuminating position. A document conveying mechanism is located upstream and downstream of the illuminating position with respect to the direction in which the document is inserted. The document conveying mechanism is reversibly driven for conveying the document to a position upstream of the turning section and a position downstream of the illuminating position. An accommodating section is positioned between the document table and the illuminating position and capable of accommodating the document conveyed from the turning section when the document conveying mechanism is reversed. A path selector selectively steers the document being conveyed by the document conveying mechanism either to the inlet or to the accommodating section. A document edge sensor adjoins the illuminating position for sensing the leading edge of the document being conveyed by the document conveying mechanism. A controller controls the document conveying mechanism and path selector in response to the number of times of reciprocation of the document to occur and the output of the document edge sensor.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 7:
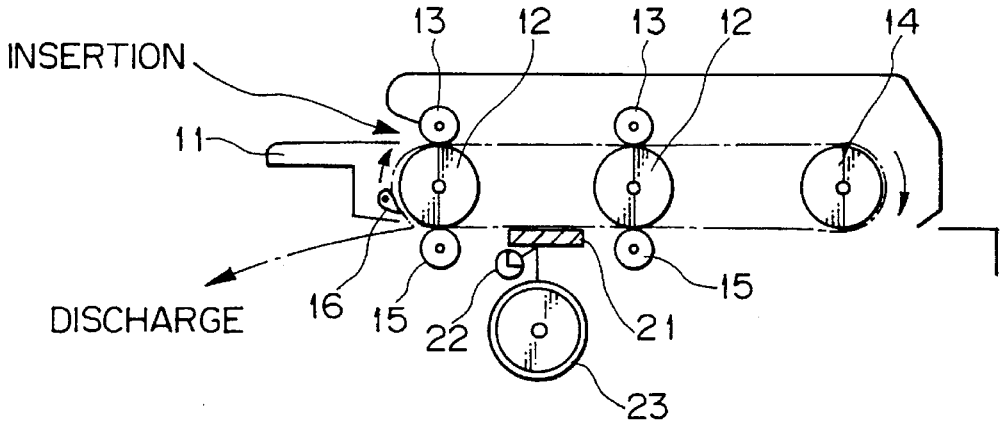
Fig. 7 PRIOR ART
FIGS. 7 and 8 are sectional side elevations respectively showing a first and a second conventional device.

To better understand the present invention, the conventional first and second types of document feeding devices will be described specifically. Referring to FIG. 7, the first type of device, using the loop circulation system, has drive rollers 12 and driven rollers 13 respectively disposed above the drive rollers 12. The drive rollers 12 and driven rollers 13 cooperate to convey a document from a document table 11 to a turn roller 14 by nipping it. The turn roller 14 turns over the document by driving it into a turn path, not shown. Driven rollers 15 are respectively positioned below the drive rollers 12 and cooperate with the drive rollers 12 to convey the document coming out of the turn path on and along a glass platen 21. At this instant, a path selector in the form of a pawl 16 is positioned such that the drive rollers 12 turn over the document by driving it into a turn path, not shown, and again convey it in cooperation with the driven rollers 13. In this manner, the document is circulated a plurality of times along such a loop. As soon as the document is passed over the glass platen 21 a predetermined number of times, the path selector 16 is repositioned such that the document moved away from the glass platen 21 is driven out of the device.

Figure 8:
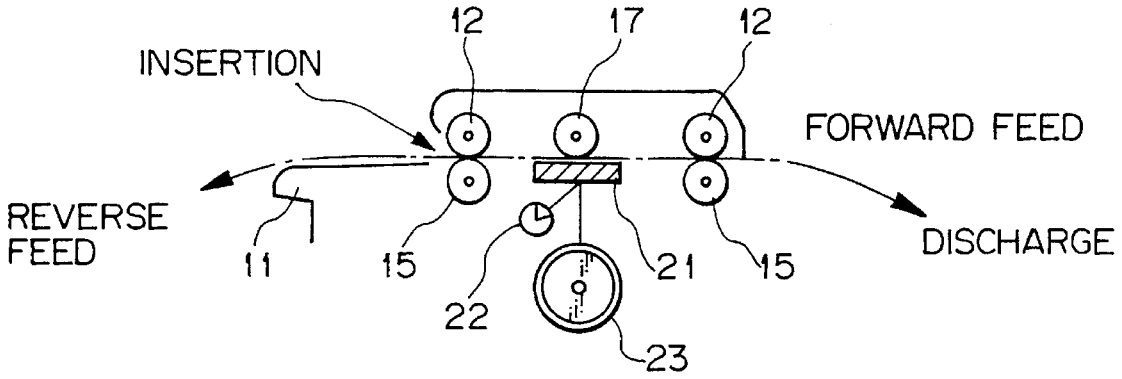
Fig. 8 PRIOR ART

FIG. 8 shows the second type of device using the horizontal reciprocation system. As shown, the drive rollers 12 and driven rollers 15 convey the document from the document table 11 on and along the glass platen 21. Subsequently, the drive rollers 12 are reversed to return the document to the table 11. In this manner, the drive rollers 12 are repeatedly rotated forward and backward to move the same document horizontally in a reciprocating motion. The reference numeral 17 designates a white roller for pressing the document against the glass platen 21.

Figure 9:
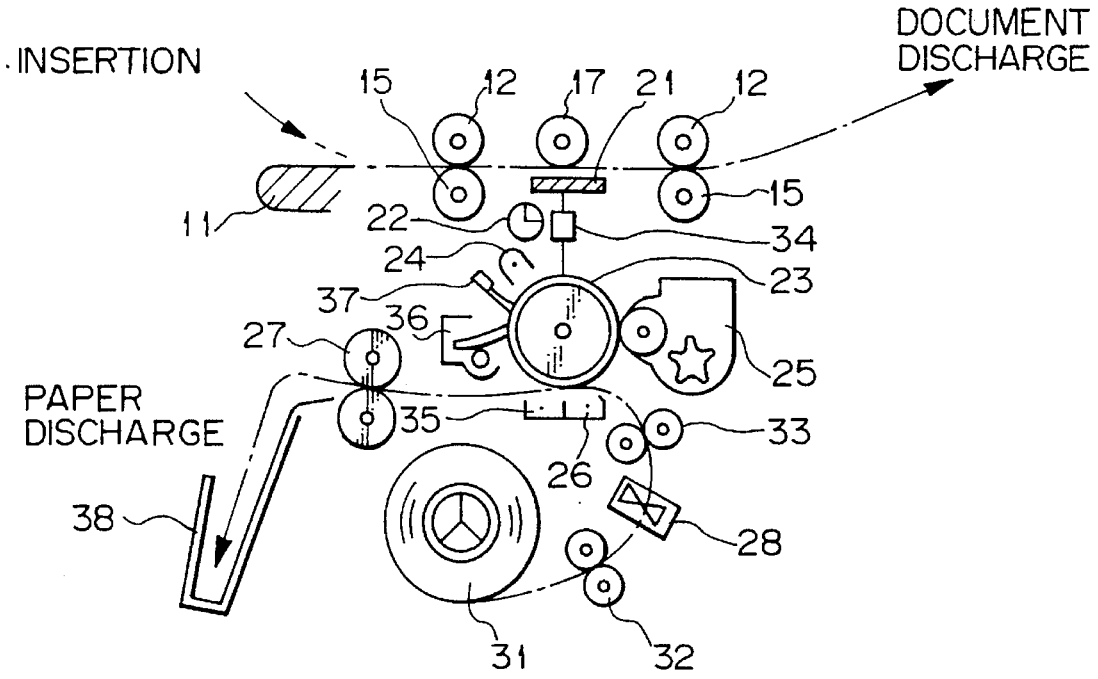
Fig. 9 PRIOR ART
FIG. 9 is a sectional side elevation of a document reading device on which the second conventional device is mounted.

The first type or the second type of device is mounted on a document reading device including a lamp 22. When the document reading device illuminates the document with the lamp 22, the resulting imagewise reflection is incident to a photoconductive drum 23. As a result, a latent image representing the document electrostatically formed on the drum 23. Specifically, FIG. 9 shows an image forming apparatus implemented with the second type of conventional document conveying device. As shown, the drum 23 is uniformly charged by a main charger 24 while rotating clockwise. The document is conveyed from the left to the right, as viewed in the figure. Imagewise light representing the document image is incident to the drum 23 to form a latent image thereon. A developing unit 25 develops the latent image to produce a corresponding toner image. A transfer charger 26 transfers the toner image from the drum 23 to a paper moving in contact with the drum 23. A heat roller 27 fixes the toner image on the paper by heat. The paper for such image transfer is a webbing paid out from a roll 31 by a feed roller 32. The feed roller 32 and a registration roller 33 drive the paper to between the drum 23 and the transfer charger 26 in synchronism with the rotation of the drum 23. After the image transfer from the drum 23 to the paper, a cutter 28 cuts the paper at a predetermined length matching the image. The cut piece of paper is driven out of the apparatus via the heat roller 27. There are also shown in the figure a lens 34 through which the imagewise light from the document is propagated to the drum 23, a separation charger 35 for separating the paper carrying the toner image from the drum 23, a cleaning unit 36 for cleaning the drum 23 after image transfer, a discharge lamp 37 for dissipating potentials remaining on the drum 23, and a stacker 38 for stacking the consecutive papers cut by the cutter 28 and driven out by the heat roller 27.

The problem with the first type of document conveying device is that a document of relatively large size cannot be repeatedly circulated via the glass platen 21 unless the loop is long enough to accommodate even such a document, as discussed earlier. Such a long loop makes the device bulky and increases the number of parts and, therefore, the cost.

Figure 10:
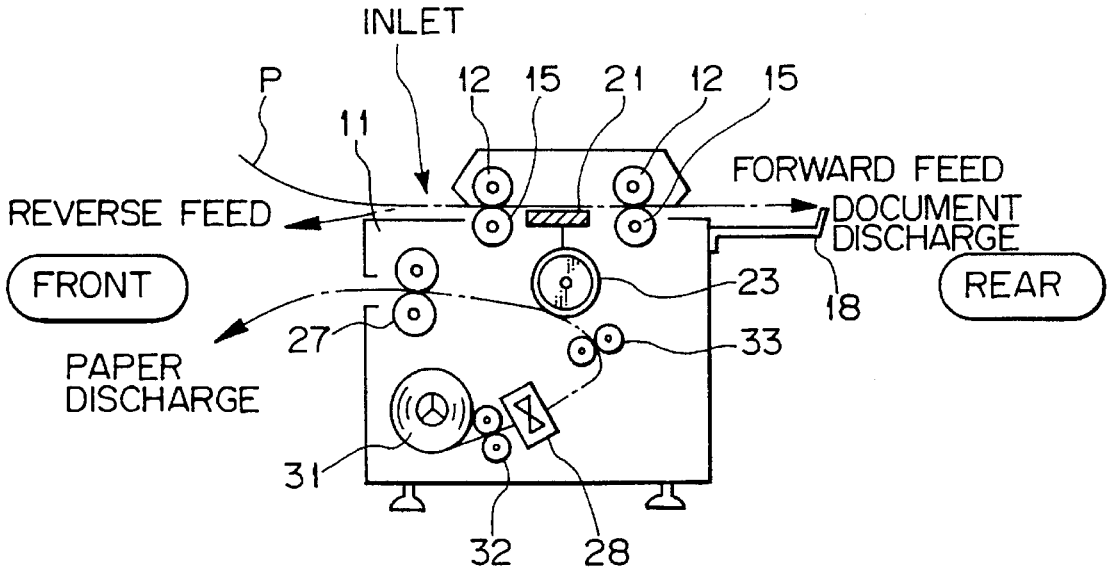
Fig. 10 PRIOR ART
FIG. 10 is a view demonstrating a problem particular to the device shown in FIG. 9.

The second type of device is tree from this problem. Specifically, as shown in FIG. 10, the second type of device causes the drive rollers 12 to convey a document P horizontally in a reciprocating motion between an upstream position and a downstream position via the glass platen 21. However, the second type of device has the following problem. As to the first type of device, a document expected to be turned over is stacked on the document table 11 face up and, therefore, easy to see the orientation of an image. However, with the second type of device, it is necessary to lay the document on the table 11 face down since it is not turned over during the reciprocating motion. Hence, it is troublesome to see the orientation of an image when, for example, the leading edge of a paper should be left blank over a desired distance. Moreover, since the document fed forward is again returned to the table 11, another document to be scanned cannot be laid on the table 11 beforehand. This lowers the maneuverability of the device.

Figure 11:
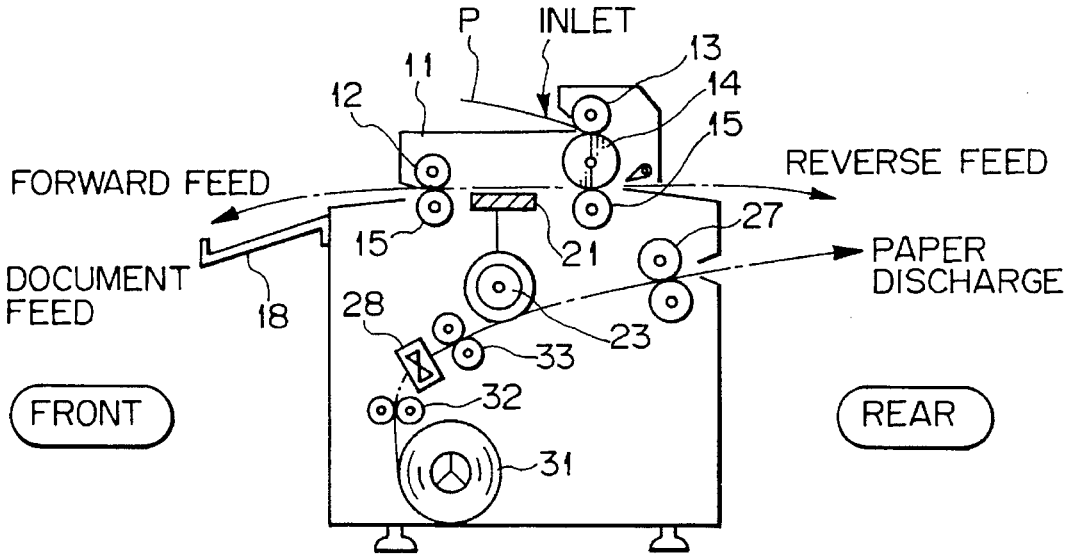
Fig. 11 PRIOR ART
FIG. 11 is a side elevation of a third conventional device.

The problems stated above can be obviated by the third type of conventional document conveying device taught in Japanese Patent Laid-Open Publication No. 4-29543, as described previously. Specifically, as shown in FIG. 11, the third type of device, like the first type of device, has the document table 11 above the glass platen 21 and causes the turn roller 14 and driven roller 13 to turn over a document P via a turn path, not shown. At the same time, this type of device causes the drive roller 12, turn roller 14 and driven roller 15 to convey the document P horizontally in a reciprocating motion via the glass platen 21. Even the third type of device has some issues yet to be solved, as follows. Since the document P is turned over and then moved along the glass platen 21, it is driven out to a document tray 18 located at the left-hand side, as viewed in the figure. A document reading device loaded with the third type of device illuminates the document P being moved from the right to the left, so that the drum 23 is rotated counterclockwise to discharge the paper to the right. Generally, therefore, a document reading device capable of reading a document P having, for example, a great width is so oriented as to locate the operating section thereof at the left-hand side, as viewed in the figure. Then, since the papers are driven out to the right-hand side or rear of the apparatus, the operator cannot take them out unless stepping round to the rear of the apparatus. This is also true with the first type of device. The second type of device allows the table 11 and stackers 38 to be located at the front of the apparatus since it moves the document P back and forth horizontally. However, even the second type of device forces the operator to step round to the rear of the apparatus for taking out the document P received by the tray 18.

Figure 1:
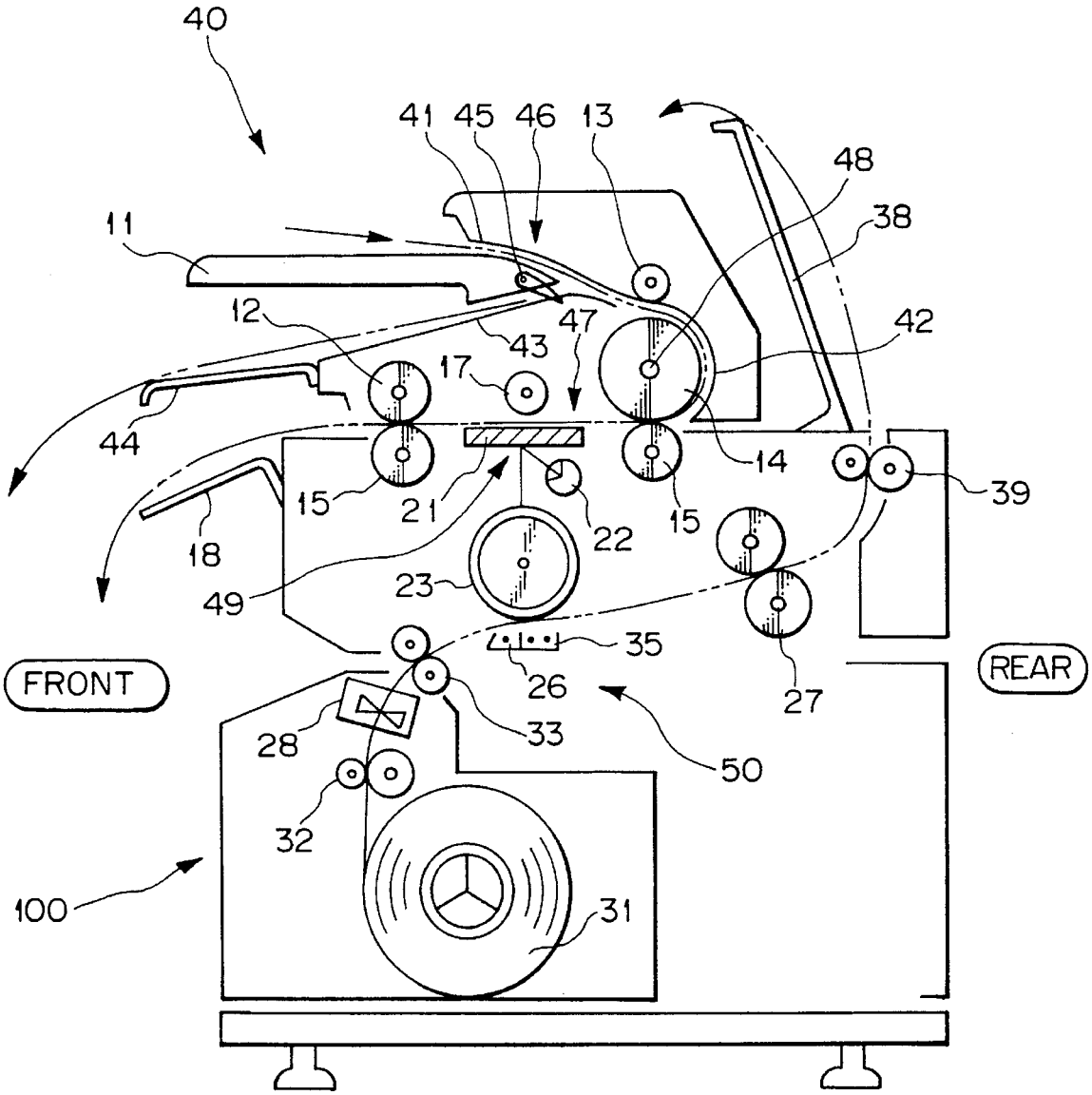
FIG. 1 is a side elevation of a document reading device on which a document conveying device embodying the present invention is mounted.
Figure 12:
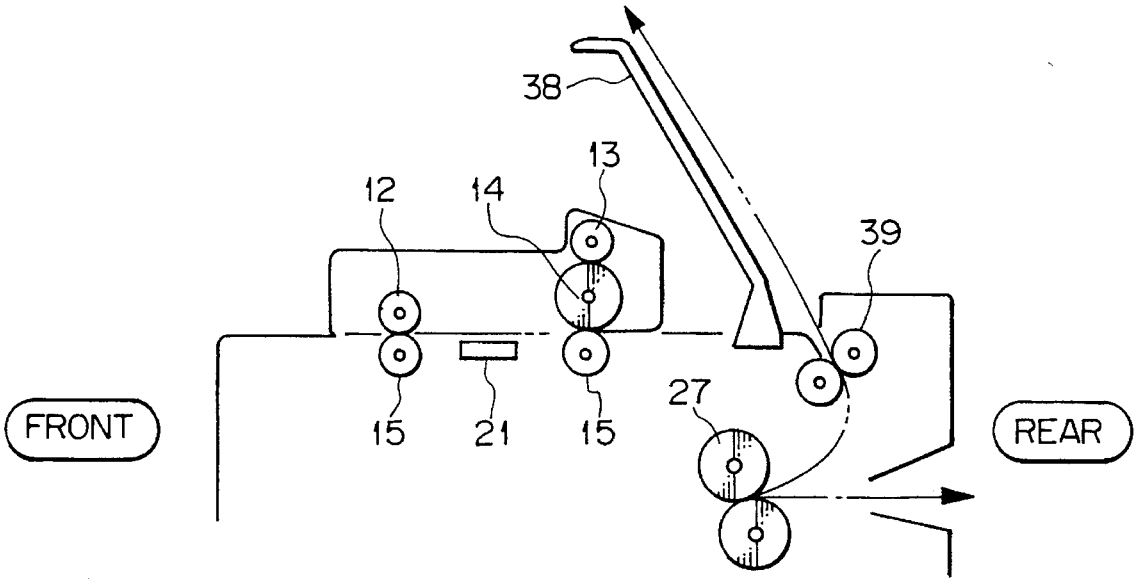
Fig. 12 PRIOR ART
FIG. 12 is a view demonstrating a problem particular to the device shown in FIG. 11.

FIG. 12 shows an arrangement which may be contemplated in order to eliminate the above problems. In this arrangement, the third type of document conveying device is mounted on a document reading device. As shown, a paper expected to be driven out by the heat roller 27 (as indicated by a dash-and-dot line) is redirected to a discharge roller 39. As a result, the discharge roller 39 discharges the paper to the top rear side, as indicated by a dash-and-dots line. A stacker 38 for stacking papers is mounted on the top of the document reading device. Such a scheme will allow both the document P and the papers to be collected at the front of the apparatus. However, this cannot be done with the horizontal reciprocation system since the document P is moved horizontally even to the top rear side of the apparatus where the paper should be driven out. Referring to FIGS. 1–5, a document reading device on which a document conveying device embodying the present invention is mounted is shown. In the figures, the same or similar constituent parts as or to the parts of the conventional document conveying device are designated by the same reference numerals, and a detailed description thereof will not be made in order to avoid redundancy. As shown in FIG. 1, the document reading device is implemented as a copier 100 and loaded with a document conveying device 40 including a document table 11. A document P is laid on the table 11 and guided into an inlet 41 thereby. The inlet 41 is located above a glass platen 21. A reversible turn roller, or drive roller, 14 is positioned upstream, or right-hand side as viewed in the figure, of the glass platen 21. A reversible drive roller 12 is positioned downstream, or left-hand side, of the glass platen 21. A driven roller 13 is pressed against the turn roller 14 by a predetermined pressure and driven by the roller 14. Driven rollers 15 are respectively pressed against the drive roller 12 and turn roller 14 by a predetermined pressure to be driven thereby. A white roller 17 is pressed against the glass platen 21 by a predetermined pressure. A document tray 18 receives the document P moved away from the glass platen 21. The drive roller 12, turn roller 14 and driven rollers 15 constitute conveying means in combination.

The document conveying device 40 has a turn path (turning section) 42 extending along the surface of the turn roller 14. The document P inserted into the inlet 41 is turned over and guided to the glass platen (exposure position) 21 by the turn path 42. A path 43 extends between the table 11 and the glass platen 21 such that the document P returned from the turn path 42 enters the path 43. A document tray 44 receives the document P returned from the turn path 42 via the path 43. A path selector 45 is implemented as a pawl and selects either the inlet 41 or the path 43, as needed. An insertion sensor 46 is positioned in the vicinity of the inlet 41 and responsive to the leading edge of the document P inserted into the inlet 41. A registration sensor, or document edge sensing means, 47 is positioned upstream of the glass platen 21 and responsive to the leading edge or the trailing edge of the document P. A controller or control means, not shown, receives a control signal from the copier 100 and the outputs of various sensors including the insertion sensor 46 and registration sensor 47. The control signal from the copier 100 indicates the number of times of reciprocation to occur. In response to such inputs, the controller drives, based on a control program, a motor 48 for driving the drive roller 12 and the path selector 45. The path 43 and tray 44 constitute an accommodating section in combination. The turn roller 14 has a greater diameter than the drive roller 12 in order to guide the document P along the turn path 42 while turning it over.

The copier 100 has, in addition to the glass platen 21, a lamp 22, a photoconductive drum 23, a transfer charger 26, a heat roller 27, a cutter 28, a feed roller 32, a registration roller 33, a separation charger 35, a paper stacker 38, and an outlet roller 39. Further, the copier 100, like the copier of FIG. 9, has a main charger, developing unit, lens, cleaning unit, and discharge lamp although they are not shown in FIG. 1. A paper roll 31 is positioned at the right-hand side, as viewed in the figure. The paper or webbing paid out from the roll 31 is fed to the drum 23 in synchronism with the counterclockwise rotation of the drum 23. After a toner image, corresponding to the image of the document P, has been transferred and fixed on the paper, the paper is driven out by the outlet roller 39 to the stacker 38 adjoining the conveying device 40. Specifically, the outlet roller 39 is so positioned as to discharge the paper to the top right portion of the copier 100. The glass platen 21, lamp 22, drum 23 and lens 34 constitute an exposing section 49. The feed roller 32 and registration roller 33 constitute paper conveying means. The main charger, developing unit, transfer charger 26, separation charger 35, cleaning unit and discharge lamp constitute an image transfer section 50. Further, the outlet roller 39 and the paper stacker 38 serve as paper discharging means and paper holding means, respectively.

Figure 2:
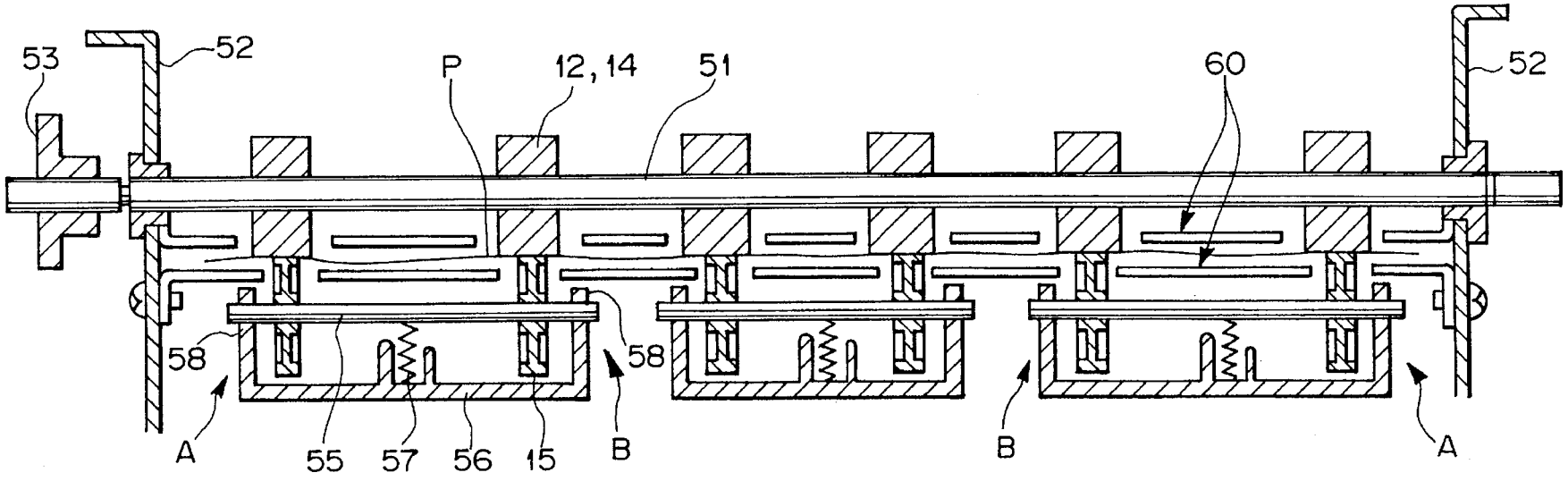
FIG. 2 is a sectional front view of essential part of the embodiment.
Figure 3:
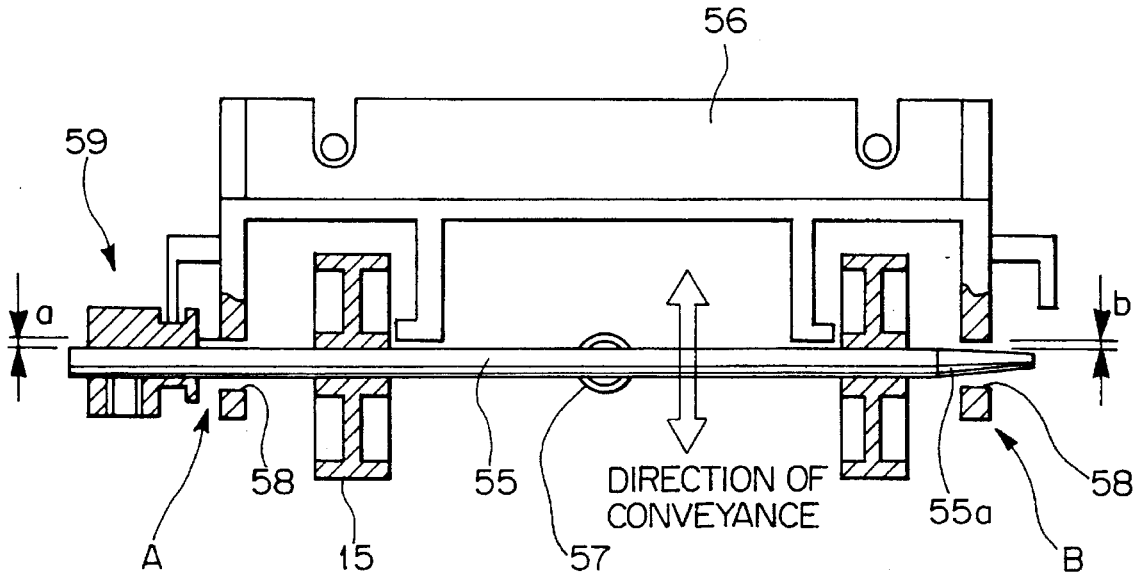
FIG. 3 is an enlarged sectional plan view showing essential part of the arrangement of FIG. 2.

As shown in FIGS. 2 and 3, a plurality of drive rollers 12 or a plurality of turn rollers 14 are affixed to a rotary shaft 51. The shaft 51 is journalled to a chassis 52 and connected to the motor 48 by a gearing 53 including a drive gear 53. A pair of driven rollers 15 are affixed to the opposite ends of each of a plurality of rotary shafts 55, and each cooperates with one of the drive rollers 12 or turn rollers 14. The rotary shafts 51 are each journalled to a respective shaft holder 56 at opposite ends thereof. The intermediate portion of the shaft 51 is constantly biased by a spring 57 toward the drive rollers 12 or turn rollers 14 associated therewith. As shown in FIG. 3, the shaft holder 56 has support portions 58 each being spaced apart from the periphery of the shaft 55 by a predetermined gap at the end thereof in the direction of conveyance of the document P (up-and-down direction as viewed in the figure). The support portions 58 support both ends of the shaft 55 such that the shaft 55 is freely movable toward the drive rollers 12 or turn rollers 14. At the same time, on contacting the periphery of the shaft 55, the support portions 58 restrict the movement of the shaft 55 in the direction of conveyance of the document P.

One or outer end of the rotary shaft 55 adjoining one side edge of the document (labeled A in FIG. 3) is spaced apart from the associated support portion 58 of the shaft holder 58 by a gap a (necessary for loose fit). The other or inner end of the shaft 55 (labeled B in the figure) is implemented as a tapered end 55*a* whose diameter sequentially decreases. When the shaft 55 is slid in the thrust direction, a gap b between the tapered end 55*a* and the associated support portion 58 changes. An adjuster 59 is rotatably supported by the end of the shaft holder 56 adjoining the side edge of the document P. The shaft 55 is fastened to the adjuster 59 by a screw. When the fastening position of the adjuster 59 is changed, the tapered end 55*a* slides in the thrust direction to set up a desired gap b. The tapered end 55*a* and adjuster 59 play the role of gap adjusting means in combination.

Figure 4:
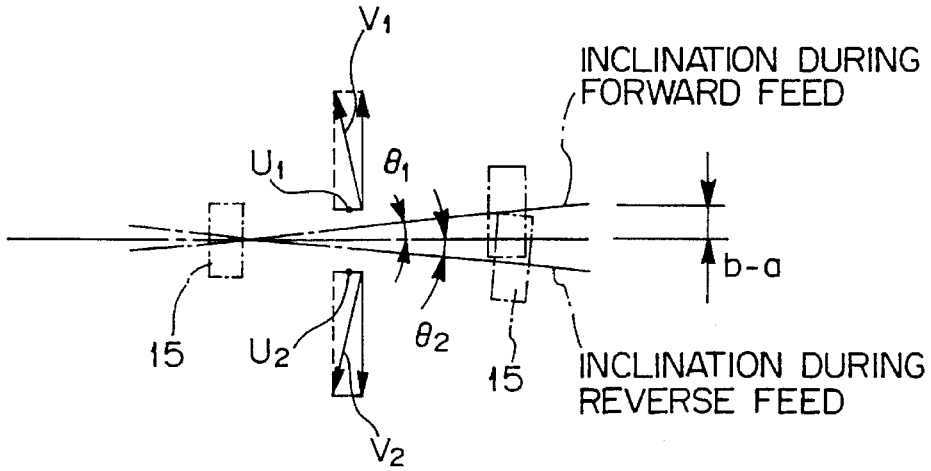
FIG. 4 is fragmentary view of the arrangement of FIG. 3.

As stated above, the shaft 55 is supported by the support portions 56 of the shaft holder 58 in such a manner as to be movable over the gap a at one side A and over the gap b at the other side B. The driven rollers 15 are respectively driven by the reversible drive rollers 12 or turn rollers 14 with the intermediary of the document P. Therefore, when the fastening position on the adjuster 59 is changed to make the gap b greater than the gap a, the shaft 55 is caused to move in a particular amount at each of the outer side A and inner side B. As a result, as shown in FIG. 4, the shaft 55 inclines an angle θ1 in the forward feed direction or an angle θ2 in the reverse feed direction relative to the shaft 51 of the rollers 12 or 14. The driven rollers 15, therefore, have vectors V1 and V2 and exert vectors u1 and u2 on the document in the direction perpendicular to the direction of conveyance.

The gap b between the end of the shaft 55 and the support portion 58 of the shaft holder 56 at the inner side B is adjusted as follows. Assume that the diameters of the drive rollers 12, turn rollers 14 and driven rollers 13 and 15 for conveying the document P and/or the pressures acting thereon via the document P are not uniform, or that the axes of such rollers are not perpendicular to the direction of document conveyance. Then, the document P in conveyance runs askew or becomes offset to the right or the left, resulting in the displacement of an image on a paper. When the position of an image on a paper is displaced, the position of the shaft 55 fastened to the adjuster 59 is adjusted to cause the vector u1 or u2 to act on the document P.

Figure 5:
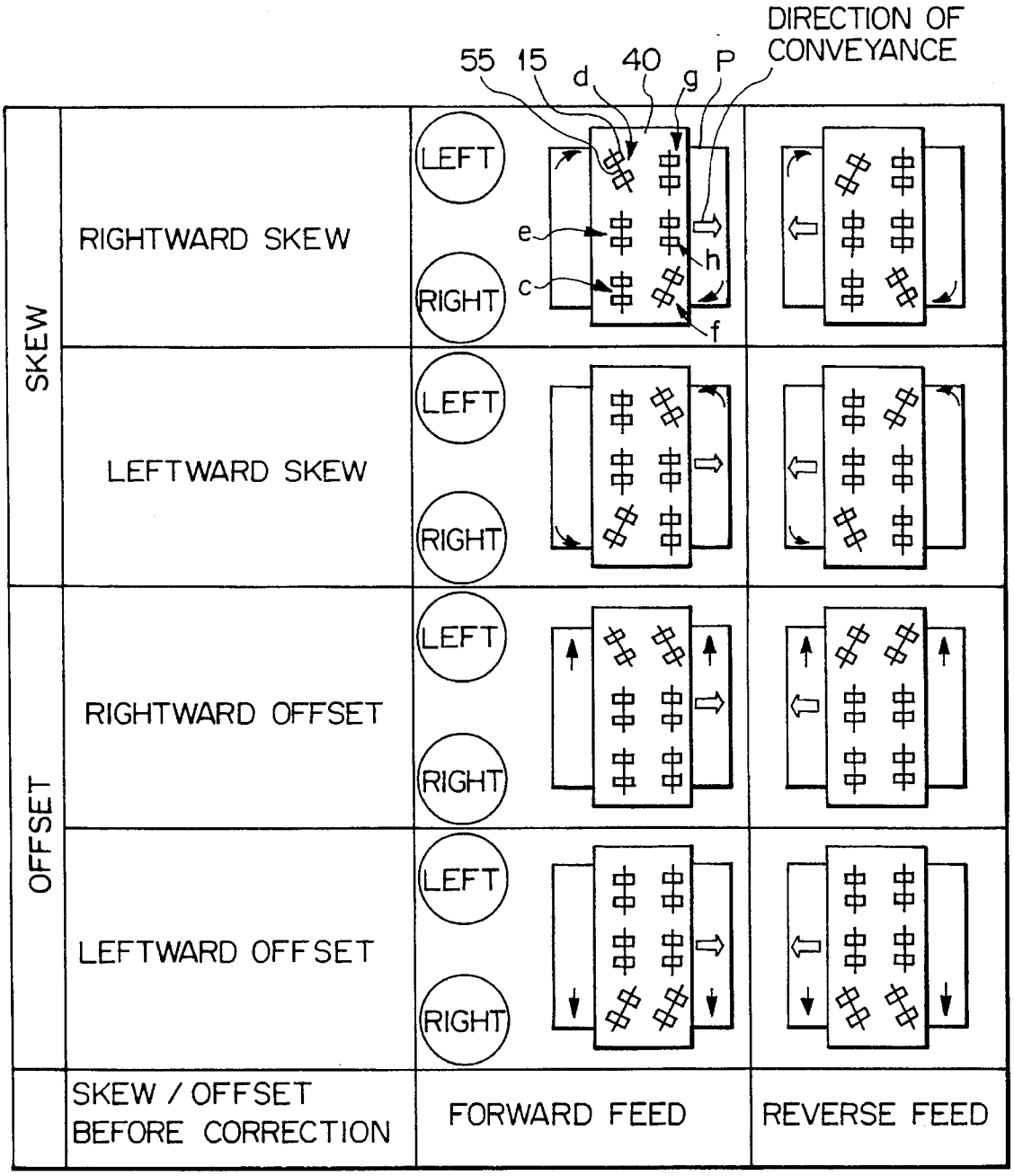
FIG. 5 is a table listing the adjustment of the essential part of the embodiment.

For example, as shown in FIG. 5, assuming that the document P is moved forward, the opposite side edges of the document P with respect to the direction of conveyance will be referred to as the right edge and the left edge, respectively. In the same sense, assume that the right driven rollers 15, facing the associated turn rollers 14, are located at a position c, that the left driven rollers 15 are located at a position d, and that the intermediate driven rollers 15 are located at a position e. Further, assume that the right driven rollers 15, facing the associated drive rollers 12, are located at a position f, that the left driven rollers 15 are located at a position g, and the intermediate driven rollers 15 are located at a position h. In addition, assume that the inclination of the shaft 55 of the driven rollers 15 causes the document P to skew in an amount S or become offset in an amount Y, that the amount of skew and the offset of the document P not attributable to the inclination are respectively SO and YO, that the amount of rightward skew and the rightward offset are represented by a positive sign, and that the amount of leftward skew and the leftward offset are represented by a negative sign.

When a rightward occurs, the fastening positions of the adjusters 59 are selectively changed such that the shafts 55 of the driven rollers 15 at the positions d and f each inclines a predetermined angle, but the shafts 55 of the driven rollers 15 at the positions c, e, g and h do not incline. In this condition, the driven rollers 15 at the position d and the driven rollers 15 at the position f respectively exert the vectors u1 and u2 on the document P and thereby cause it to become offset to the left and to the right. As a result, the document P undergoes a leftward, i.e., the skew S becomes substantially equal to −SO. This successfully corrects the skew of the document P and thereby corrects the displacement of an image on a paper. It is to be noted that the inclination angles of such shafts 55 should be substantially the same.

In the event of a leftward skew, the fastening positions of the adjusters 59 are selectively changed such that the shafts 55 of the driven rollers 59 at the positions c and g each inclines by a predetermine angle but the shafts 55 of the driven rollers 15 at the positions d, e, g and h do not incline. This causes the document P to perform a rightward skew.

When a rightward offset occurs, the adjusters 59 are selectively repositioned such that the shafts 55 of the driven roller 15 at the positions d and g each inclines a predetermined angle, but the shafts 55 of the driven rollers 15 at the positions c, e, f and h do not incline. In this condition, the driven rollers 15 at the positions positions d and g respectively exert the vectors u1 and u2 on the document P, causing it to become offset to the left. As a result, the offset Y becomes substantially equal to −Y0. This successfully corrects the offset of the document P and thereby corrects the displacement of an image on a paper.

In the event of an offset to the left, the adjusters 59 are selectively repositioned such that the shafts 55 of the driven rollers 15 at the positions c and f incline a predetermined angle, but the shafts 55 of the driven rollers 15 at the positions d, e, g and h do not incline. As a result, an offset to the right is produced.

Further, when a skew and an offset occur at the same time, the shafts 55 of the driven rollers 15 are selectively inclined in matching relation to the skew and offset. For example, in the event of a rightward skew and a rightward offset, the shaft 55 at the position d is inclined by an angle correcting both the skew and the offset, the shaft 55 at the position f is inclined by an angle correcting the skew, the shaft 55 at the position g is inclined by an angle correcting the offset, and the shafts 55 at the positions c, e and h are not inclined. As a result, the document P is caused to run askew and become offset leftward.

In FIG. 2, the reference numeral 60 designates a guide for guiding the document P to between the drive roller 12 or turn roller 14 and the driven roller 15.

The operation of the embodiment will be described hereinafter. While the drive roller 12 and turn roller 14 are driven at the same time, the following description will sometimes concentrate on one of them for a clarity purpose. First, as shown in FIG. 1, the document P is laid on the table 11 face up and inserted into the inlet 41. When the insertion sensor 46 senses the leading edge of the document P, the turn roller 14 is driven forward (clockwise in FIG. 1). The turn roller 14 cooperates with the driven roller 13 to convey the document P along the turn path 42. At this instant, the path selector 45 is so positioned as to steer the document into the inlet 41. Subsequently, the document P is conveyed by the turn roller 14 and driven roller 15. As soon as the registration sensor 47 senses the leading edge of the document P, the rotation of the turn roller 14 is stopped to interrupt the conveyance.

Subsequently, the paper is paid out from the roll 31 by the feed roller 32 and then conveyed by the registration roller to between the drum 23 and the transfer charger 26. The drive roller 12, turn roller 14 and drum 23 are rotated in synchronism with the transport of the paper. As a result, the document P turned over, i.e., positioned face down is sequentially illuminated from the leading edge thereof while being conveyed over the glass platen 21. After a toner image representing the document P has been transferred to the paper, the former is fixed on the latter by the heat roller 27. The paper carrying the toner image thereon is driven out to the paper stacker 38. The document P, moved away from the glass platen 21, is conveyed to the document tray 18 by the drive roller 12 and driven roller 15. In a single illumination mode, the document P is simply held on the tray 18.

In a multiple illumination mode, after the registration sensor 47 has sensed the trailing edge of the document P, the drive roller 12 is caused to stop rotating at a predetermined timing. The document P is, therefore, held stationary by having the trailing edge thereof nipped by the drive roller 12 and driven roller 15. The path selector 45 is actuated select the path 43 in place of the inlet 41. In this condition, to the drive roller 12 and turn roller 14 are rotated in the reverse direction at a speed twice as high as the forward rotation speed. Consequently, the document P is conveyed in the reverse direction, turned over by the path 42, and then conveyed to the document tray 44 via the path 43. As soon as the registration sensor 47 senses the leading edge of the document P, the drive roller 12 and turn roller 14 are brought to a stop, nipping the leading edge of the document P.

The reciprocation of the document P and the movement of the paper described above are repeated thereafter. As a result, the same document P is illuminated a plurality of times, and the same image is transferred to a plurality of papers. The papers each carrying the image thereon are sequentially stacked on the paper stacker 38. After the last illumination, the document P is driven out to the document tray 18. Another document P to be illuminated, if present, is laid on the table 11 face up and then inserted into the inlet 41 until the insertion sensor 46 senses the leading edge of the document P. This is followed by the procedure described above.

The document P in conveyance runs askew or becomes offset to the right or the left due to irregularities in the diameters, pressures and axes of the various rollers. In the illustrative embodiment, the rotary shafts 55 whose positions match the orientation of the document P can be adjusted to inclinations matching the skew or the offset o f the document P. More specifically, the shafts 55 are selectively inclined by angles which satisfy S=−S0 or Y=−Y0. Therefore, the document P is moved back and forth via the glass platen 21 while receiving the vectors u1 and u2 from the driven rollers 15 of the inclined shafts 55.

As stated above, in the embodiment, since the document P is moved along the glass platen 21 after being turned over by the turn path 42, it can be laid on the table 11 face up. This allows the operator to see the image of the document P with ease and thereby maneuverability.

In a multiple illumination mode, the path 43 is selected in place of the inlet 41. In this condition, the document P is moved back and forth without being returned to the table 11, so that the next document P can be laid on the table 11 beforehand. Consequently, a plurality of documents can be conveyed without interruption.

The table 11 and two document trays 18 and 44 are located at the left-hand side, as viewed in FIG. 1, while the document P is turned over and then moved back and forth via the glass platen 21. Hence, papers are driven out to the top rear portion of the machine. This allows the paper stacker 38 to adjoin the rear of the document conveying device 40 and allows the papers to be discharged to the top of the copier 100. It follows that the operator can collect the document P and papers at the same operating position. For example, when the document P has a great width, the operator can collect it and papers at the front of an operating section located at the left-hand side, as viewed in FIG. 1.

To convey the document P in the reverse direction, the drive roller 12 and turn roller 14 are reversed at a speed twice as high as the forward rotation speed. The reverse movement and, therefore, the entire multiple illumination mode operation completes in a short time.

Due to the previously stated configuration of the shafts 55, the driven rollers 15 of the shafts 55 matching the skew or the offset of the document P exert the vectors u1 and u2 on the document P such that the document P skews or becomes offset in the opposite direction. The document P is, therefore, moved back and forth via the glass platen 21 without any skew or offset, so that an image is accurately transferred to a paper without displacement.

The inclination of each shaft 55 can be adjusted only if it is provided with the tapered end 55a and the position of the associated adjuster 59 is changed. Hence, the skew or the offset of the document P can be corrected by a simple construction and at the time of, for example, inspection before shipment. Further, the vectors u1 and u2 act on the paper P sideways and prevents the document P from waving during conveyance.

Figure 6:
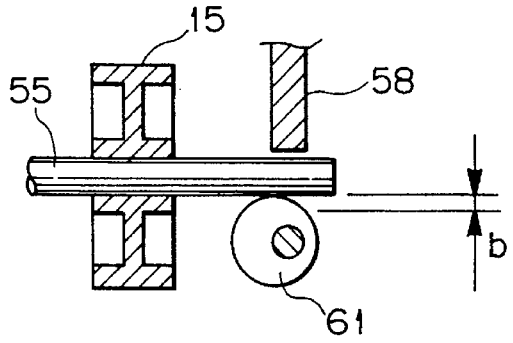
FIG. 6 is a fragmentary enlarged plan view showing a modification of the embodiment.

FIG. 6 shows a modification of the embodiment. As shown, an eccentric cam 61 is positioned at the support portion 58 of the shaft holder 56. The eccentric cam 61 can be moved to change the gap b between the support portion 58 and the shaft 55 and, therefore, the displacement of the shaft 55.

In another modification of the embodiment, separating and feeding means (pick-up roller, reverse roller, feed roller, etc.) may be located upstream of the path selector 45, FIG. 1, in order to automatically feed a stack of documents P from the table 11 one by one while separating them from each other, although not shown specifically.

In summary, it will be seen that the present invention has various unprecedented advantages as enumerated below.

(1) When a document should be moved back and forth, a transport path is switched from an inlet of a document table to an accommodating section between the table and an illuminating position. In this condition, a document is turned over and then moved back and forth via the illuminating position. Therefore, the document can be laid on the table face up. The document can be moved via the illuminating position a plurality of times without being returned to the table. Hence, when a plurality of documents should be conveyed to the illuminating position, the next document can be laid on the table beforehand and conveyed after the preceding document. As a result, a document conveying device using the horizontal reciprocation system is achievable which is easy to operate and inexpensive.

(2) Driven rollers are mounted on a rotary shaft which is supported by shaft holders at opposite ends thereof. A gap is formed between the shaft and a support portion included in each shaft holder. Gap adjusting means is provided for adjusting the gap. Hence, the shaft of the driven rollers can be inclined by a simple configuration on the basis of the difference in gap between the opposite ends of the shaft. Simply by adjusting the gap, it is possible to adjust the inclination of the shaft with ease. The inclination of the shaft exerts a force on a document in a predetermined direction. It follows that the skew or the offset of a document can be corrected if the gap between the support portion and the shaft is adjusted. As a result, an accurate and inexpensive document conveying device is realized.

Various modifications will become possible for those skilled in the art after receiving the teachings of the present disclosure without departing from the scope thereof.

What is claimed is:

1. A document conveying device mounted on a document reading device which sequentially reads a document image moving via an illuminating position with an illuminating section thereof from one edge of said document, and for conveying, when an image of a single document is illuminated by said document reading device a plurality of times, said single document in a reciprocating motion via said illuminating position, said device comprising:

a document table located above the illuminating section and for supporting a document laid thereon and guiding said document to an inlet;

a turning section for turning over the document inserted into said inlet and guiding said document to the illuminating position;

document conveying means located upstream and downstream of the illuminating position with respect to a direction in which the document is inserted, said document conveying means being reversibly driven for conveying said document to a position upstream of said turning section and a position downstream of said illuminating position;

an accommodating section positioned between said document table and the illuminating position and capable of accommodating the document conveyed from said turning section when said document conveying means is reversed;

a path selector for selectively steering the document being conveyed by said document conveying means either to said inlet or to said accommodating section;

document edge sensing means adjoining the illuminating position for sensing a leading edge of the document being conveyed by said document conveying means; and control means for controlling said document conveying means and said path selector in response to a number of times of reciprocation of the document to occur and an output of said document edge sensing means.

2. A device as claimed in claim 1, wherein said document conveying means comprises:

reversible drive rollers respectively rotatable in contact with at least opposite side edges of the document;

at least two driven rollers constantly biased by respective resilient members having predetermined resiliency, and respectively driven by said drive rollers contacting the opposite side edges of the document with the intermediary of the document;

shaft holders each supporting a rotary shaft of said respective driven rollers;

said shaft holders each comprising support portions respectively spaced apart from peripheries of opposite ends of said respective rotary shaft by a predetermined gap at least in an intended direction of document conveyance while allowing said rotary shaft to freely move toward said drive rollers, but restricting a movement of said rotary shaft in said intended direction of document conveyance in abutment against said rotary shaft; and gap adjusting means for adjusting at least one of said gaps respectively formed between the outer peripheries of said rotary shaft and said support portions which are respectively positioned at an outer side and an inner side with respect to the document.

3. A device as claimed in claim 2, wherein assuming that when said rotary shafts are selectively inclined by a predetermined angle relative to a shaft of said drive rollers on the basis of a difference between said gaps, said driven rollers on said inclined shafts cause the document to skew in an amount S in contact with said driven rollers or cause said document to become offset in an amount Y, that a skew and an offset not attributable to the inclination of said rotary shafts respectively occur in amounts S0 and Y0, and that a rightward skew and a rightward offset and a leftward skew and a leftward offset are respectively represented by a positive sign and a negative sign, said gap adjusting means adjusts said gaps such that S=−S0 and Y=−Y0 hold.

4. A device as claimed in claim 1, wherein said document reading device comprises:

an illuminating section for sequentially reading the document moving via the illuminating section by illuminating said document from one edge;

paper conveying means for conveying a paper to the illuminating section;

an image transfer section for transferring an image representing the document illuminated by said illuminating section to the paper;

paper discharging means for discharging the paper carrying the image thereon via a top portion of said document reading device other than a portion where said document conveying device is mounted; and a paper holding member provided on the top portion of said document reading device and adjoining said document conveying device, and for holding the paper discharged by said paper discharging means.

* * * * *